US007728725B2

(12) United States Patent
Cecil

(10) Patent No.: US 7,728,725 B2
(45) **Date of Patent: *Jun. 1, 2010**

(54) INTRUSION DETECTION SYSTEM FOR UNDERGROUND/ABOVE GROUND APPLICATIONS USING RADIO FREQUENCY IDENTIFICATION TRANSPONDERS

(76) Inventor: Kenneth B. Cecil, 3184 Sage Glen, Escondido, CA (US) 92029

( * ) Notice: Subject to any disclaimer, the term of this patent is extended or adjusted under 35 U.S.C. 154(b) by 267 days.

This patent is subject to a terminal disclaimer.

(21) Appl. No.: 12/073,287

(22) Filed: Mar. 4, 2008

(65) Prior Publication Data

US 2009/0309724 A1 Dec. 17, 2009

(51) Int. Cl.
*G08B 13/00* (2006.01)

(52) U.S. Cl. ..... 340/541; 340/572.1; 340/573.1

(58) Field of Classification Search ..... 340/10.1, 340/10.4, 539.16, 541, 552, 572.1, 573.1; 700/79, 80

See application file for complete search history.

(56) References Cited

U.S. PATENT DOCUMENTS

| | | | | |
|---|---|---|---|---|
| 4,213,122 | A | 7/1980 | Rotman et al. | 340/552 |
| 4,588,988 | A | 5/1986 | Karas | 340/552 |
| 4,879,544 | A | 11/1989 | Maki et al. | 340/552 |
| 4,887,069 | A | 12/1989 | Maki et al. | 340/552 |
| 5,049,858 | A | 9/1991 | Price | 340/552 |
| 5,093,639 | A | 3/1992 | Franchi et al. | 333/24 R |
| 5,406,263 | A | 4/1995 | Tuttle | 340/572.1 |
| 5,446,446 | A | 8/1995 | Harman | 340/566 |
| 5,510,766 | A | 4/1996 | Harman et al. | 340/552 |
| 5,581,236 | A | 12/1996 | Hoseit et al. | 340/511 |
| 5,581,237 | A | 12/1996 | DiPoala | 340/554 |
| 5,682,143 | A | 10/1997 | Brady et al. | 340/572.7 |
| 5,781,108 | A | 7/1998 | Jacob et al. | 340/552 |
| 5,936,524 | A | 8/1999 | Zhevelev et al. | 340/552 |
| 6,188,318 | B1 | 2/2001 | Katz et al. | 340/545.3 |
| 6,424,259 | B1 | 7/2002 | Gagnon | 340/554 |
| 6,577,236 | B2 | 6/2003 | Harman | 340/552 |
| 6,731,210 | B2 | 5/2004 | Swanson et al. | 340/566 |
| 6,888,459 | B2 | 5/2005 | Stilp | 340/541 |
| 7,069,160 | B2 | 6/2006 | Cecil | 702/59 |

OTHER PUBLICATIONS

Maki et al., CWD Sensors for Intrusion Detection Systems-An Updated, 1995 IEEE, pp. 317-324.

Birch, A., Advantages of Redeployable & Relocatable Security Systems, 1994 IEEE, pp. 180-184.

*Primary Examiner*—Jeffery Hofsass
(74) *Attorney, Agent, or Firm*—Hoffman, Wasson & Gitler

(57) ABSTRACT

The present invention is directed to an underground as well as above ground system and method of determining the intrusion into a security zone. One or more transceivers would transmit a unique electromagnetic signal which would power a response from one or more RFID transponders. Each of the transponders would transmit a unique code to the transceiver indicating that there has been no intrusion in the vicinity of that transponder. Failure of a transponder to receive a signal produced by a transponder, would indicate the existence of an intrusion. The transponders as well as the transceivers can be provided in a PVC pipe buried in the ground, or provided in or on a structure located on or above the ground.

23 Claims, 4 Drawing Sheets

INTRUSION DETECTION SYSTEM FOR UNDERGROUND/ABOVE GROUND APPLICATIONS USING RADIO FREQUENCY IDENTIFICATION TRANSPONDERS

FIELD OF THE INVENTION

The present invention is directed to the field of establishing an underground or above ground intrusion detection system utilizing radio frequency identification (RFID) transponders.

BACKGROUND OF THE INVENTION

Over the last several years and particularly since September 11, there has been a significant increase in the number of intrusions into various security zones as well as acts of international terrorism. Although a large amount of time, effort and money has been budgeted to agencies like the Department of Homeland Security, these intrusions and attempts to protect individuals as well as property have not lessened the threat.

Access control devices supervise access at perimeter doors of a facility, but fail to detect vandalism or terrorist threats to the exterior of the facility and the immediate vicinity of a structure or area to be protected.

Existing perimeter security systems and the prior art consist of CCTV cameras, sense cables either buried or attached to metal fences, infrared (IR) and microwave sensors. Limitations are the rule since CCTV cameras are less effective at night and both IR sensors and CCTV cameras are compromised by fog and rain. Furthermore, IR and microwave sensors do not locate the point of the attempted intrusion and fence cables are limited to the use with metal fences. Buried cable sensors require significant site engineering. None of the present solutions can locate intrusions accurately on hard surfaces such as brick walls or buildings.

Vibration based systems often result in false-positive alarms due to trucks traveling on nearby roads, weather, lightening, sonic booms from military aircraft, vibrations from trees/shrubs and animals as well as earthquakes, tremors, seismic rumblings and explosions. Repair and maintenance are frequent and costly. Sophisticated software requiring complicated algorithms must also be developed to determine the approximate location of an alarm.

U.S. Pat. No. 7,069,160 overcomes the shortcomings of the older technologies by utilizing radio frequency identification (RFID) passive proximity microchips to precisely locate intrusions regardless of weather or of the structural material it is attached to or imbedded in. However, this patent includes a power transmission cable that broadcasts an RF UHF signal and a data transmission cable with transponder microchips connected by a data bus that are powered by the transmission cable via electromagnetic coupling. Therefore, an intrusion is sensed by interference in the ability of the transponders to receive the EM field by an individual entering the field. Hydrogen absorption inhibits the EM field by an individual entering the field, and the transponder(s) fail to communicate their encrypted code down the data bus.

BRIEF DESCRIPTION OF THE INVENTION

The teachings of the present invention results in many benefits. For example, the manner in which the intrusion detection system of the present invention is constructed around or under a security zone would greatly reduce the site work in engineering that was formerly required in the prior art devices. Since off-the-shelf RFID transponders are utilized, the cost of establishing the intrusion detection system with respect to the security zone is greatly reduced. Furthermore, because the RFID transponders are passive, maintenance and repair work are simplified or significantly eliminated. This is particularly true since the RFID transponders operate on energy received from the electromagnetic field radiated from operating transceivers. Each of the transponders has a unique encrypted identification code further adding to the security of the system by eliminating non-encrypted transponders from being powered by the EM field.

Because the present invention does not require that the transponders or transceivers are affixed to metal fences, the system can be easily installed on hard surfaces, such as brick or concrete walls as well as the side of buildings and metal structures.

The present invention is also designed to identify the exact longitudinal locations of an intrusion in real time within 18 inches (46 cm). It would also result in a very low false alarm rate since blowing debris and small animals will not cause an intrusion alarm.

The present invention is directed to a method and system for producing an above ground or below ground security zone. A transceiver module (TM) would be provided with one or more radio frequency (RF) transceivers. The plurality of radio frequency identification (RFID) transponders would be associated with the TM. The TM would be positioned to broadcast an electromagnetic (EM) field to excite the RFID transponders. The TM would be in communication with a system controller (SC), a CPU as well as a display. The CPU and display would generally be located at a central location, such as a guard station or a central monitoring command center. If one or more of the RFID transponders would not respond to the EM signals transmitted from the TM, an intrusion would be sensed and an appropriate alarm would be sounded and/or transmitted to the display. The RFID transponders would either transmit a unique code directly to a transceiver after being powered from the EM field, or will directly transmit the unique code to the SC via a data bus.

DETAILED DESCRIPTION OF THE INVENTION

Figure 1:
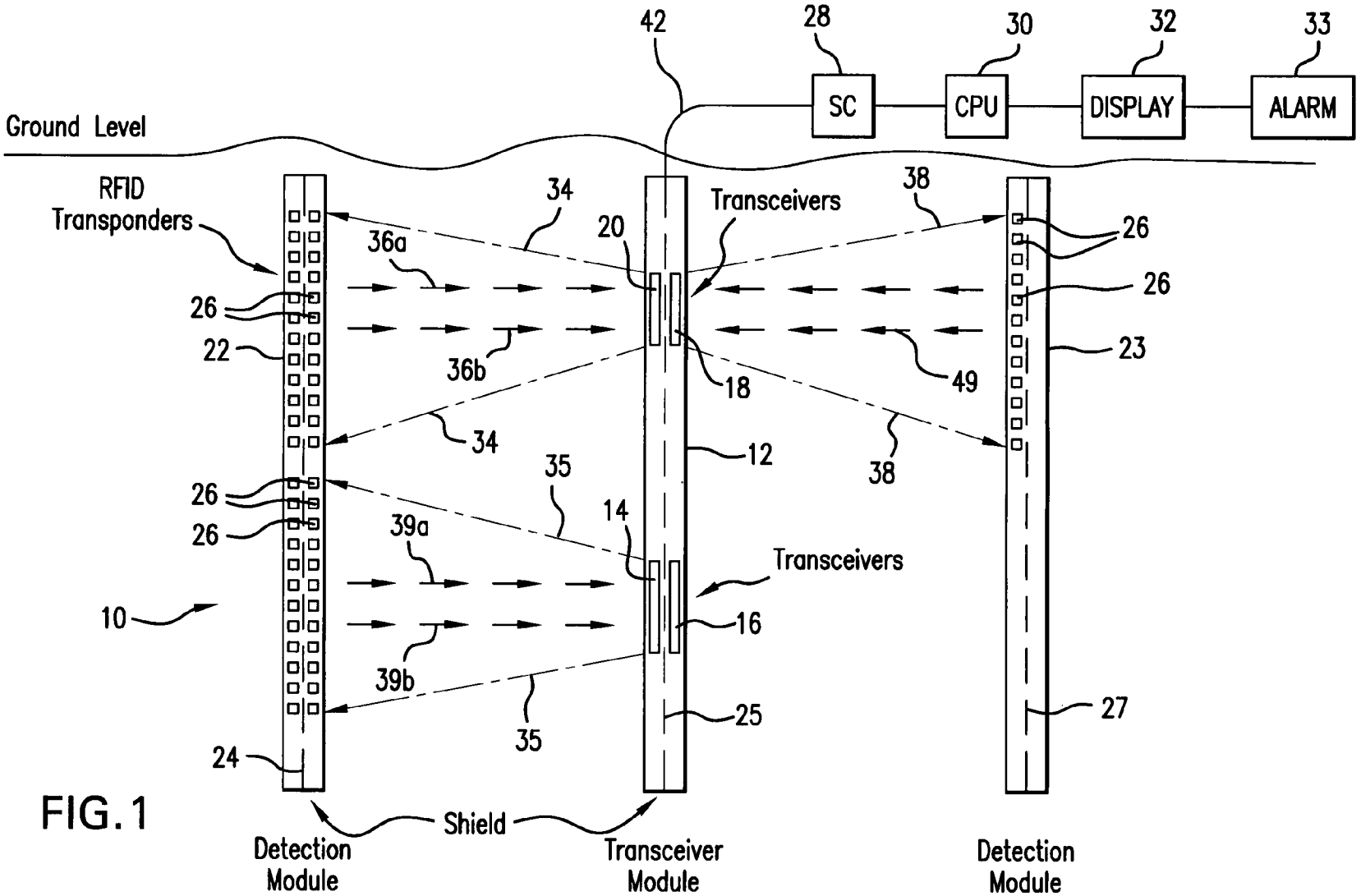
FIG. 1 is a schematic drawing showing a first embodiment of the present invention.

As illustrated in FIG. 1, a first embodiment of the present invention would include a transceiver module (TM) 12 as well as two detection modules (DM) 22, 23. As can be appreciated, additional TMs as well as additional DMs could be employed. The TMs and the DMs would be buried in holes drilled vertically along the perimeter of the below ground level and parallel to each security zone (SZ) 10. The TM 12 would generally consist of a PVC or plastic pipe placed vertically in the ground. The TM would include radio frequency (RF) transceivers 14, 16, 18 and 20. It can be appreciated that more or less transceivers can be included in each TM. The detection modules 22, 23 would consist of a plurality of radio frequency identification (RFID) passive transponders placed in the PVC or plastic pipe at approximately one foot intervals. Similar to the TM 12, the PVC or plastic pipe is vertically inserted into the ground. The detection modules 22, 23 would be separated from the TM 12 at a distance of approximately 6-12 feet.

The RF transceivers 14, 16, 18 and 20 would broadcast an RF frequency such as shown by 34, 35 or 38 allowed by the FCC and/or other governmental agencies, such as a UHF radio signal. An electromagnetic (EM) inductive coupling would be established between the transceivers in the TM 12 and the passive RFID transponders 26 in DM 22, 23. The RF signal produced by the transceivers 14, 16, 18 and 20 would power the RFID transponders 26. Each of the RF transceivers 14, 16, 18 and 20 would broadcast its unique signal to the RFID transponders 26 which would then transmit its own unique code back to its respective RF transceiver 14, 16, 18 and 20.

For example, each of the transceivers 14, 16, 18 and 20 would produce a unique coded signal directed to only a portion of the total number of RFID transponders. Although the exact number is not important, it has been found that each of the transceivers 14, 16, 18 and 20 could supervise up to 20 RFID transponders. Therefore, signal 34 generated by transceiver 20 is directed to the RFID transponders 26 provided on the top right portion of detection module 22. Each individual transponder 26 in that section of the detection module 22 would produce its own unique signal which is then directed back to the transceiver 20. For example, one of the transponders 26 would produce a signal 36*a* and a second transponder would produce a signal 36*b*.

Although not depicted in FIG. 1, if there is no intrusion and the system is operating correctly, each of the transponders 26 provided on the top right portion of the detection module 22 would produce a signal directed toward transceiver 20. Similarly, transceiver 14 would produce a signal 35 directed to all of the transponders provided on the bottom right portion of the detection module 22. Each of these transponders 26 would produce a signal having its own unique code such as signals 39*a* and 39*b*. Finally, transceiver 18 would produce a signal 38 directed to the RFID transponders 26 included in the detection module 23.

Responsive to the signal from transceiver 18, each of the RFID transponders 26 would produce a signal having its own unique code such as signal 40 which is received by the transceiver 18. It is noted that based upon the configuration of the security zone 10, not all of the transceivers would be transmitting information, such as transceiver 16 in TM 12. This is due to the fact that the detection module 23 does not have any RFID transponders located therein. If the configuration of the area to be projected changes, detection module 23 could be removed from the DM PVC pipe and additional RFID transponders would be inserted therein and then the detection module 23 would be redeployed into the DM PVC pipe.

Each of the RF transceivers 14, 16, 18 and 20 would have a unique RF code that would allow electromagnetic inductive coupling with the RFID transponders within its field, thereby enabling each of the RFID transponders only when they sense the proper code transmitted by the RF transceivers, thereby protecting the integrity of the security zone by not allowing any stray RF signals or intentional spoofing from RF emitting devices to reduce the integrity of the security zone.

Each of the transceivers 14, 16, 18 and 20 included in the TM 12 would be powered by a continuous cable 42 and would be equipped with a buffered memory, allowing for storage of the transmissions from its associated RFID transponders. It would also include anti-collision firmware, allowing for each RFID transponder to be read independently of other RFID transponders reporting at the same time. The length of the PVC pipes 12, 22 and 23 can vary based upon the requirements of the detection field. Multiple TMs 12 and DMs 22 are placed at defined distances, such as between 6 and 12 feet apart to cover an extended area.

As shown in FIG. 1, a single TM 12 will allow a transceiver 20 to produce an RF signal 34 to be directed to one set of RFID transponders, whereas transceiver 18 would transmit an RF signal 38 directed to a second set of transponders provided in detection module 23. The first set of transponders would produce signals 36*a* and 36*b* directed to the transceiver 20 and one of the second set of transponders would produce a signal 40 directed to transceiver 18. Therefore, different sets of RFID transponders can be placed in a single module PVC or plastic pipe as well as various sets of transceivers can also be placed in a single TM module including PVC or plastic pipe 12. All of the modules 22 and 23 would include a foil strip 24 or 27 running the length of the pipe and separating sets of transponders from themselves to limit the electromagnetic inductive coupling field to the EM field of one TM. The detection field may be deep in the ground or close to the surface and extended over a considerable distance to establish the security zone. Similarly, the TM module 12 would have a foil strip 25 running its length to separate, for example, transceiver 18 from transceiver 20 and transceiver 14 from transceiver 16.

Each of the TMs 12 would be connected to a watertight fitting at the top of the pipe which is also equipped with a tamper switch connected to a system controller 28 via the conductor cable 42. The system controller communicates with a CPU 30 containing firmware and software therein that can adjust the sensitivity of each of the transceivers 14, 16, 18 and 20, as well as correlate the transponder's code to distances in feet or meters and perform diagnostic operations.

The array of RFID transponders in each DM 22 would identify its location to the firmware in the security controller 28 through use of its unique code, and the fact that the exact location of each RFID transponder within its respective module 22, 23 is known and included in the memory of the SC 28 and/or CPU 30. The security controller 28 is polled by the CPU 30, which in turn polls the transceiver 14, 16, 18 and 20 and displays the location of an intrusion on a screen or on an enunciated panel of the display 30. An audio alarm 33 could produce a signal based on the sensing of an intrusion. A line drawing diagram locating each DM 22, 23 or a more sophisticated dimensional drawing or map overlay can be used to display each alarm location within the security zone. Thus, any digging, tunneling or trenching would cause one or more of the RFID transponders 26 to fail to produce a signal transmitted to its respective transponder, thereby resulting in an alarm intrusion. The alarm detection and its location would be reported to the security controller 28. Cutting a network line or cutting as well as tampering with a TM 12 or a DM 22, 23 would also create an alarm and establish the specific location of the intrusion.

Each transponder 26 would send a signal with its own unique code based upon the receipt of the proper signal from its assigned transceiver, either directly to the security controller 28 as will be explained with respect to FIG. 3, or to its assigned transceiver which would save this information in its buffered memory. Thereafter, when the security controller 28 polls each of the transceivers, the information received from all of the transponders assigned to that transceiver would be transmitted to the security controller 28 under control of the CPU 30. The present invention will be able to detect an intrusion since the transmission signal either from the transceivers or from the transponders at certain UHF frequencies, such as 900 MHz requires a line of sight and therefore would be interrupted by anyone entering the field or breaking the signal since the field is absorbed by hydrogen and 70% of the human body is water. Therefore, the lack of response from a particular transponder or transponders would result in the security controller making a determination that there has been an intrusion. This in turn would be reported to the CPU 30 allowing the location of the intrusion to be displayed and an alarm sounded. The firmware and software utilized by the present invention is relatively simple since the encrypted transponder codes can be used instead of time telemetry algorithms currently used by vibration sensors.

In normal operation, the security controller 28 would periodically or continually poll the buffered memory in each of the transponders of the TM 12 and thereby review the RFID transponder identification codes stored therein. Any intrusion within the supervised security zone would be detected by the security controller 28 in conjunction with the CPU 30, since the appropriate transceiver would not receive transmission from one or more of the RFID transponders, due to the blocking of the transmission signal or signals by the intrusion, or by blocking the transceiver signals broadcast to the RFID transponders. The failure to receive the signal or signals would create an alarm condition and the location of the alarm is determined by the security controller 28 and identified by the CPU 30 and displayed on the display 32 as well as producing an audio signal by alarm 33.

Figure 2:
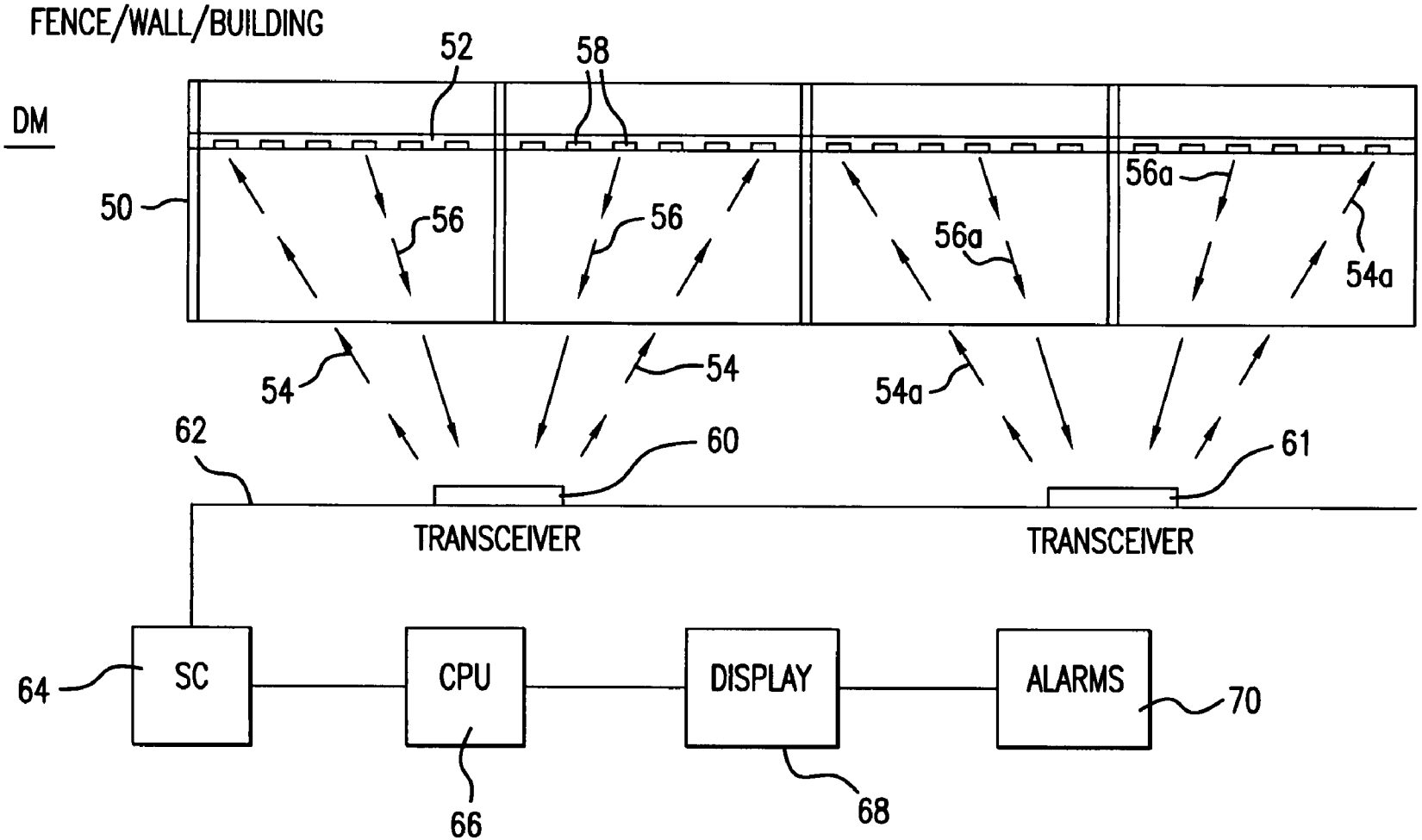
FIG. 2 is a schematic drawing showing a second embodiment of the present invention.

FIG. 2 illustrates a second embodiment of the present invention. This embodiment would allow the present invention to be used for the above ground supervision of a fence, brick or concrete walls, monuments and other objects 50. Above ground transceivers 60 or 61 would broadcast coded RF signal 54, or 54*a* respectively, to power a plurality of RFID transponders 58 arranged on or in a cable 52 which could be housed in a PVC pipe provided horizontally on and attached to the fence, building or other structure 50. Alternatively, the RFID transponders 58 could be arranged on a surface or embedded in or behind surfaces (i.e., wood, brick/concrete). The RFID transponders 58 would respond to one of the transceivers 60, 61 through electromagnetic inductive coupling and transmit their unique code 56 to be received by its respective transceiver 60, 61. The transceiver 60, 61 would periodically or continually broadcast the electromagnetic field as its unique code for each transceivers 60, 61 and the RFID transponders 58 would continually send a unique code back to the transceiver 60 where it is stored in a data file memory. A security controller would continuously or periodically poll the memory of the transceivers 60, 61 through a secure line 62. Intrusion into the field would cause one or more of the RFID transponders to stop reporting, since either the signal produced by the transceivers 60, 61 was blocked by the intrusion or the signal produced by one or more RFID transponders 58 was blocked by the intrusion, or both the transceiver and transponder signals are blocked. If any of these conditions occur, it would be noted. The failure of one or more transponders to report would be cross-referenced with location information revealing the exact location of the intrusion. Furthermore, an audio alarm could also be produced by alarm 70 by the security controller 64 as well as the CPU 66 which would display not only the existence of an intrusion, but also the exact position of the intrusion on a display 68.

Figure 3:
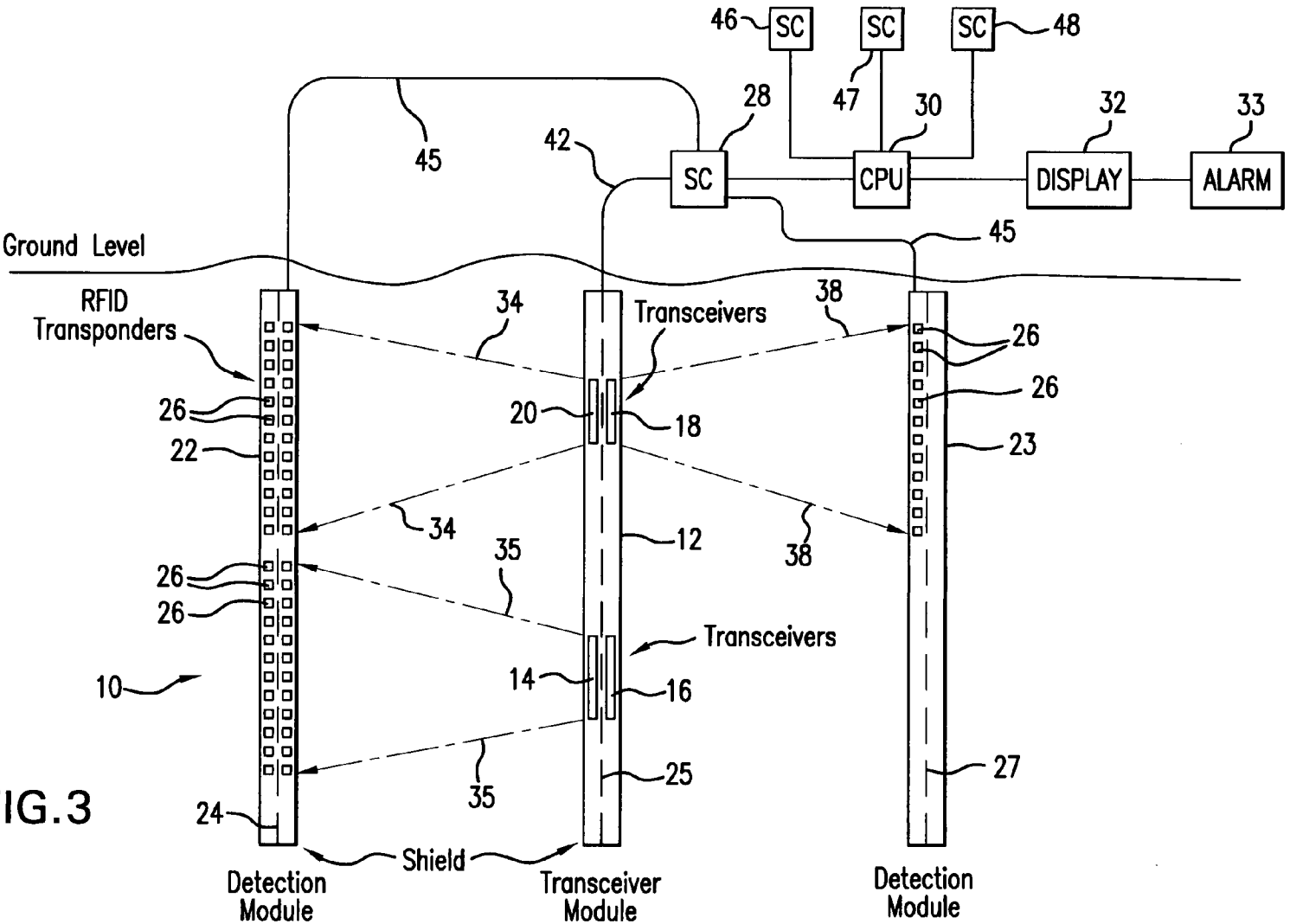
FIG. 3 is a schematic drawing showing an alternative to the first embodiment.

FIG. 3 illustrates a situation in which each of the detection modules 22, 23 is connected to the security controller 28 by a conductor cable 44 or 45. In this situation, the security module 28 will continuously or periodically instruct the transceivers 14, 16, 18 and 20 to transmit their appropriate signal directed to their various RFID transponders. Once these signals are received from the appropriate RFID transponders, the RFID transponders would transmit their unique code to the security controller 28 through one of the conductor cables 44, 45. The failure of one or more of the RFID transponders to receive a signal from a respective transceiver would be noted by the security controller 28 which would then, through the CPU 30 display the location of the intrusion or breach on the display 32 as well as to sound an alarm 33. FIG. 3 also illustrates the situation in which a single CPU 30 controls the operation of a plurality of security controllers 46, 47 and 48. Additionally, although FIG. 3 shows the use of transceivers 14, 16, 18 and 20 to produce a signal or signals directed to the RFID transponders, since the transponders send signals to the security controller 28 and not back to the transceivers, RF transmitters can be used instead of the transceivers as will be explained with regard to FIG. 4.

The present invention through the use of the security controller 28 and the CPU 30 would be able to disarm one or more of the transceivers and RFID transponders for maintenance purposes. Once the maintenance is complete, those transceivers and RFID transponders which were disarmed would then be armed.

The present invention could interface with existing systems such as motion, fire, CCTV and access control systems as well as to transmit the occurrence of a breach as well as its location to pagers, PDAs, SMART phones and other devices.

Figure 4:
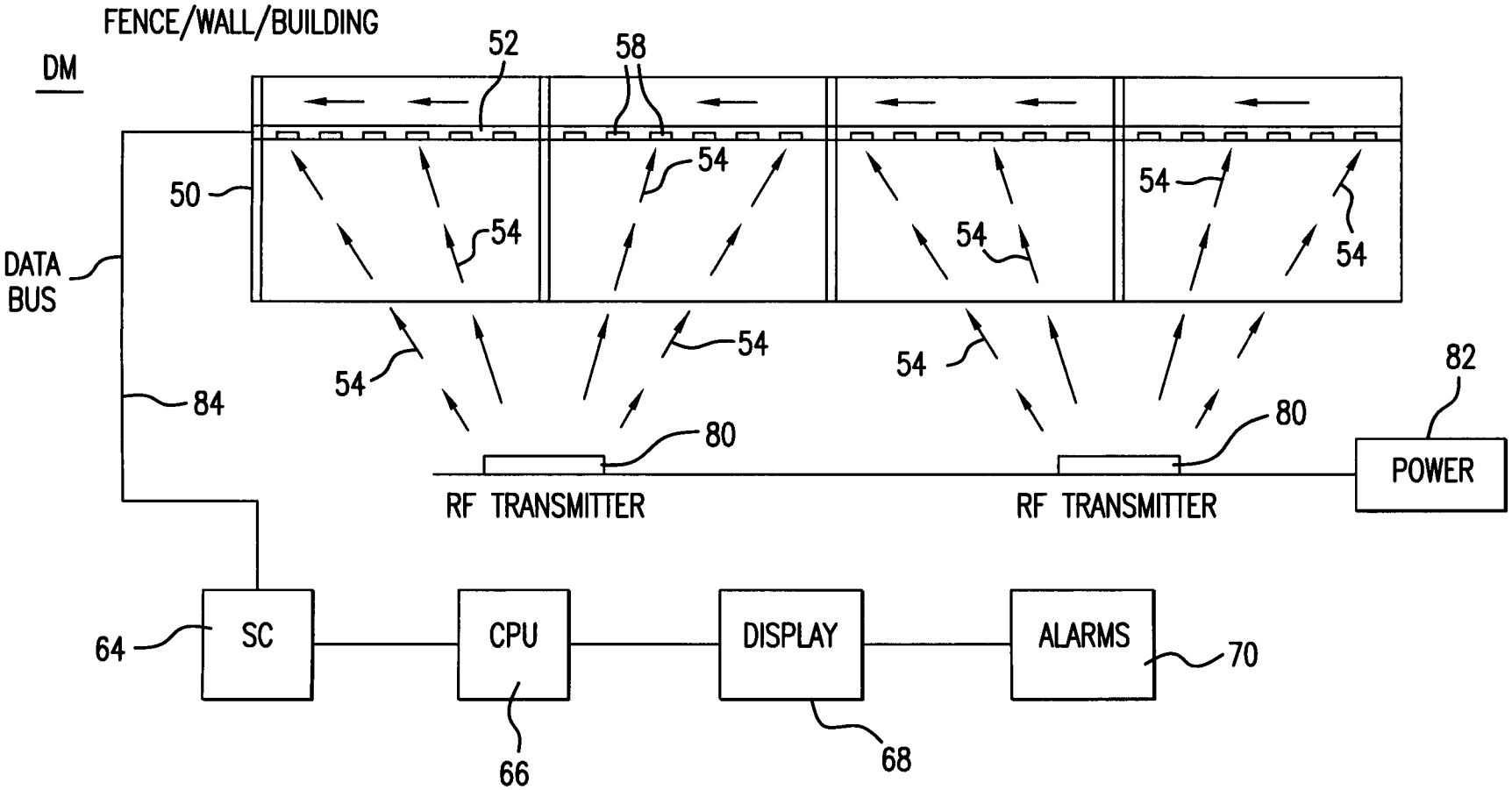
FIG. 4 is a schematic drawing showing an alternative to the second embodiment of the present invention.

FIG. 4 illustrates another alternative of the present invention. In this embodiment, an RF transmitter 80 is used instead of the transceivers utilized with respect to FIGS. 1-3. The RF transmitters 80 would be powered by a power source 82 and would create the EM field which in turn would power the transponders 58 within the field. The field 50 created by each of the RF transmitters 80 would power each of the transponders 58 which in turn would send their unique encrypted code along a data bus 84 to the security controller 64, thereby eliminating the need for the RF transceivers and providing a cost reduction to the entire system. As is true with respect to the other embodiments of the present invention, any intrusion into the field would cause one or more of the transponders 58 from reporting along the data bus, thereby creating an alarm. Since each of the transponders 58 has its own unique code, the exact location of the intrusion would be transmitted to the CPU 66 and illustrated on the display 68 as well as sounding an alarm 70.

It is to be understood that the above-described embodiments of the invention are illustrative only, and that modifications thereof may occur to those skilled in the art. Accordingly, this invention is not to be regarded as limited to the embodiments disclosed herein.

What is claimed is:

1. A system for sensing the intrusion into a security zone, comprising:

at least one device transmitting a radio frequency signal;

a plurality of transponders receiving the signal transmitted from said at least one device, each of said plurality of transponders transmitting a signal responsive to the signal transmitted from said at least one device; and a control means for controlling the operation of the system;

wherein the presence of an intruder into the security zone is sensed by the failure of said control means to receive a signal generated by at least one of said transponders responsive to the signal transmitted from said at least one device.

2. The system in accordance with claim 1, including (n) devices and wherein said plurality of transponders contains (n) sets of RFID transponders, and further wherein each of said devices produces a signal directed to all of the transponders in one set of transponders.

3. The system in accordance with claim 2, wherein each of said devices transmits a unique code and each of said plurality of RFID transponders produces a signal having a unique code responsive to the signal received from one of said devices.

4. The system in accordance with claim 3, wherein said devices are provided in at least one first container buried in the ground in or around the security zone and said RFID transponders are provided in at least one second container buried in the ground in the security zone.

5. The system in accordance with claim 3, wherein each of said n devices is a transceiver containing a memory receiving signals produced by all of the RFID transponders in one of said set of n sets of transponders.

6. The system in accordance with claim 5, wherein said control means includes a security controller for controlling the transmission of the signals produced by said transceivers and receiving information relating to the signals received by said transceivers produced by said RFID transponders.

7. The system in accordance with claim 6, wherein said control means includes a CPU and display for displaying the security zone and the location of each of said RFID transponders from which a signal is not received by said control means responsive to a signal transmitted from one of said transceivers.

8. The system in accordance with claim 7, further including an audio alarm in communication with said control means for producing an alarm based upon information received by said control means.

9. The system in accordance with claim 3, wherein said control means includes a security controller for controlling the transmission of the signals produced by said devices and receiving information relating to the signals produced by each of said RFID transponders responsive to signals transmitted by one of said devices, each of the signals produced by said RFID transponder transmitted directly to said control means.

10. The system in accordance with claim 9, further including a data bus between said security controller and said RFID transponder for receiving the signals produced by said RFID transponders.

11. The system in accordance with claim 10, wherein said control means includes a CPU and display for displaying the security zone and the location of each of said RFID transponders from which a signal is not received by said control means responsive to a signal transmitted from one of said devices.

12. The system in accordance with claim 3, wherein said RFID devices are attached to a cable affixed to a free standing object to create the security zone.

13. The system in accordance with claim 12, wherein said free standing object is a fence.

14. The system in accordance with claim 12, wherein said free standing object is a wall.

15. The system in accordance with claim 1, wherein the signals produced by said one or more devices powers each of said RFID transponders.

16. The system in accordance with claim 7, wherein said CPU contains firmware and software for controlling the sensitivity of each of said transceivers.

17. The system in accordance with claim 13, wherein said CPU contains firmware and software for controlling the sensitivity of each of said devices.

18. A method of determining whether a security zone has been the subject of an intrusion, comprising the steps of:

providing at least one device transmitting radio frequency signals in the vicinity of the security zone;

providing a plurality of RFID transponders in the vicinity of the security zone, each RFID transponder receiving a signal produced by one of said devices, the positioning of said at least one device and said plurality of RFID transponders creating the security zone;

transmitting a radio frequency signal from said at least one device directed to said plurality of RFID transponders;

each of said plurality of RFID transponders producing an output signal responsive to the receipt of the signal from at least one of said devices;

transmitting each of said output signals to a central control device, provided with the location of each of said RFID transponders;

said central control device determining whether it has received output signals from each of said RFID transponders; and said central control device determining that an intrusion has occurred based upon the non-receipt of one or more output signals from said RFID transponders due to the presence of an intruder.

19. The method in accordance with claim 18, further including the step of transmitting each of said output signals initially to one of said at least one device prior to sending each of said output signals to said central control device.

20. The method in accordance with claim 18, further including the step of directly sending each of said output signals to said central control device.

21. The method in accordance with claim 18, wherein said central control device produces a visually display showing the location of the intrusion.

22. The method in accordance with claim 18, wherein each of said at least device is a transceiver.

23. The system in accordance with claim 4, wherein said first and second containers are PVC pipes.

* * * * *